US006264054B1

(12) United States Patent
Miyake et al.

(10) Patent No.: US 6,264,054 B1
(45) Date of Patent: Jul. 24, 2001

(54) VACUUM AIRTIGHT CONTAINER

(76) Inventors: Masaharu Miyake; Kazuyo Miyake, both of 2-42, Miyamadai 2-chome, Kawanishi-shi, Hyogo-ken (JP), 666-0151

( * ) Notice: Subject to any disclaimer, the term of this patent is extended or adjusted under 35 U.S.C. 154(b) by 0 days.

(21) Appl. No.: 09/477,421

(22) Filed: Jan. 4, 2000

(30) Foreign Application Priority Data

Jan. 11, 1999 (JP) ..... 11-004326

(51) Int. Cl.[7] ..... B65D 21/00

(52) U.S. Cl. ..... 220/23.83; 220/4.12; 220/23.87; 220/23.91

(58) Field of Search ..... 220/23.83, 23.87, 220/23.89, 23.91, 4.12, 601

(56) References Cited

U.S. PATENT DOCUMENTS 3,304,852 * 2/1967 Lande ..... 220/23.87 X
4,574,776 * 3/1986 Hidle ..... 220/23.83 X
5,123,571 * 6/1992 Rebeyrolle et al. ..... 220/23.83 X
5,129,534 * 7/1992 Dunn ..... 220/4.12 X
5,386,925 * 2/1995 Lane ..... 220/4.12 X
6,145,685 * 11/2000 Dick ..... 220/23.91 X

* cited by examiner

*Primary Examiner*—Steven Pollard
(74) *Attorney, Agent, or Firm*—Jacobson Holman, PLLC

(57) ABSTRACT

A vacuum airtight container is provided in which the air left inside an inner container can be discharged by pushing and pulling the inner container and an outer container with respect to each other, and a production cost can be reduced.

In order to attain the object, the inner container in which a second check valve is disposed in a bottom portion is slidably inserted into an inner cylindrical portion of the outer container in which a first check valve is disposed in a bottom portion via a V-shaped O-ring as a sealing member. A cover member is screw fastened to an upper end opening portion of the inner container via an O-ring.

Spiral slopes are formed at regular intervals in the circumferential direction on the end face of an opening portion of the outer container. In the inner container, spiral slopes which conform to the spiral slopes are formed at regular intervals in the circumferential direction on the end face of a thick portion of a center portion of the barrel portion, thereby allowing the containers to be relatively moved in an easy manner.

10 Claims, 18 Drawing Sheets

VACUUM AIRTIGHT CONTAINER

BACKGROUND OF THE INVENTION

The invention relates to a vacuum airtight container from which the internal air can be discharged and which can be sealed after accommodating food, a material that is desirably preserved in a vacuum or low-pressure condition, or the like.

When food is exposed to air, the food is subject to oxidation by oxygen in the air, or aerobic bacteria proliferates. As a result, the food may be deteriorated or become rotten. In the case of dry food, the food may become damp by moisture in the air. When food is to be stored for a long term, conventionally, the keeping quality of the food is enhanced in the following manner. The food is accommodated in an airtight container which can be sealed by attaching a cover via a sealing member, and then refrigerated or frozen. Some foods or materials are desirably kept in a dry condition.

In the case of the above-described prior-art airtight container, the food is not exposed to the outside air, but there exists a problem in that it is impossible to completely prevent the food from being deteriorated or becoming rotten by the air left inside the container. There is a further problem in that the prior-art airtight container has a relatively complicated structure and hence the production cost is high.

SUMMARY OF THE INVENTION

The invention has been conducted in view of the above-described circumstances. It is an object of the invention to provide a vacuum airtight container from which the air left inside the container can be relatively easily discharged by sliding an inner container and an outer container each having a check valve, and in which the production cost can be lowered.

In order to solve the problems, the vacuum airtight container according to claim 1 of the invention is characterized in that a cylindrical inner container having a bottom portion provided with a second check valve which can discharge air to an outside only is slidably inserted into an inner cylindrical portion of a cylindrical outer container having a bottom portion provided with a first check valve which can discharge air to the outside only, in a hermetic condition, via a sealing member which is slidably contactable, and the inner container is hermetically sealed by attaching a cover member to a cylindrical upper end opening portion of the inner container via a sealing member.

According to the invention of claim 1, the cover member is attached to the inner container, so that the inner container can be hermetically sealed. When the inner container is repetitively inserted into or extracted from the outer container in a sliding manner, the first and second check valves disposed in the respective bottom portions are alternately opened, so that the air left inside the inner container can be sequentially discharged to the outside. Furthermore, the external air is prevented from entering the interior of the inner container by the first and second check valves, and hence the vacuum (reduced pressure) condition of the interior of the inner container is maintained. As a result, the food A accommodated in the inner container is not exposed not only to the external air but also the air left inside the inner container, so that the keeping quality can be enhanced.

The vacuum airtight container according to claim 2 is characterized in that the check valve includes a valve element which can move in a direction along which a through hole formed in the bottom portion is closed, and urging means for urging the valve element in a direction along which the through hole is opened (a check valve 8 has the same construction).

According to the invention of claim 2, the check valve can be configured with a simple structure. In the case where a rubber plate, a synthetic resin sheet, or the like is used for the valve element, particularly, the elasticity of the valve element itself eliminates the necessity of additionally using another elastic body such as a spring or the like.

The vacuum airtight container according to claim 3 is characterized in that the sealing member which is slidably contactable is an O-ring having a V-shaped section, and the sealing member is fitted into a groove which is annularly formed in an outer circumference of a cylindrical side wall of the inner container, whereby a fringing portion protruding into an outer circumferential side is pressingly contacted with an inner circumferential face of a cylindrical side wall of the outer container.

According to the invention of claim 3, the use of the O-ring having the V-shaped section surely increases the hermetic property as compared with the case of a usual O-ring having a circular section. Thus, the inner container and the outer container can be slidably moved. If, instead of one O-ring, two or more O-rings are disposed with intervals, more stable slidable property can be attained.

The vacuum airtight container according to claim 4 is characterized in that the cover member is screw fastened to a cylindrical upper end portion of the inner container via a sealing ring, thereby hermetically sealing an upper end opening portion of the inner container.

According to the invention of claim 4, the cover member can be attached to the upper end portion of the inner container with a simple structure using the screw fastening of the male screw to the female screw.

The vacuum airtight container according to claim 5 is characterized in that a male screw is formed on an outer circumference of an upper end portion of a cylindrical side wall of the inner container; an annular flange portion protruding to an outer circumferential side is disposed below the male screw on the outer circumference of the upper end of the side wall; a female screw is formed on an inner circumference of a side wall protruding downwardly from a fringing portion of the cover member; the female screw of the cover member is screw fastened to the male screw of the inner container; and a sealing ring disposed between a lower end of the side wall of the cover member and the flange portion of the inner container is pressed, thereby hermetically sealing the upper end opening portion of the inner container.

According to the invention of claim 5, a female screw is formed on the inner side of the side wall of the fringing portion of the cover member, so as to form a cover member having a cap-like shape. Therefore, the cover member can be easily attached to and detached from the inner container. In addition, it is possible to open the cover member even in the case where the interior of the inner container is in a vacuum condition.

BRIEF DESCRIPTION OF THE DRAWINGS

FIG. 12 shows the embodiment of the invention, and is a vertical section view of the vacuum airtight container which is turned upside down in a condition where the outer container is pressed in;

FIG. 24 shows the second embodiment of the invention, and is an external front view of the vacuum airtight container in a condition where the container is inverted and the outer container is pressed in; and FIG. 25 shows a third embodiment of the invention, in which

DETAILED DESCRIPTION OF THE PREFERRED EMBODIMENTS

Hereinafter preferred embodiments of the invention will be described with reference to the accompanying drawings.

Figure 1:
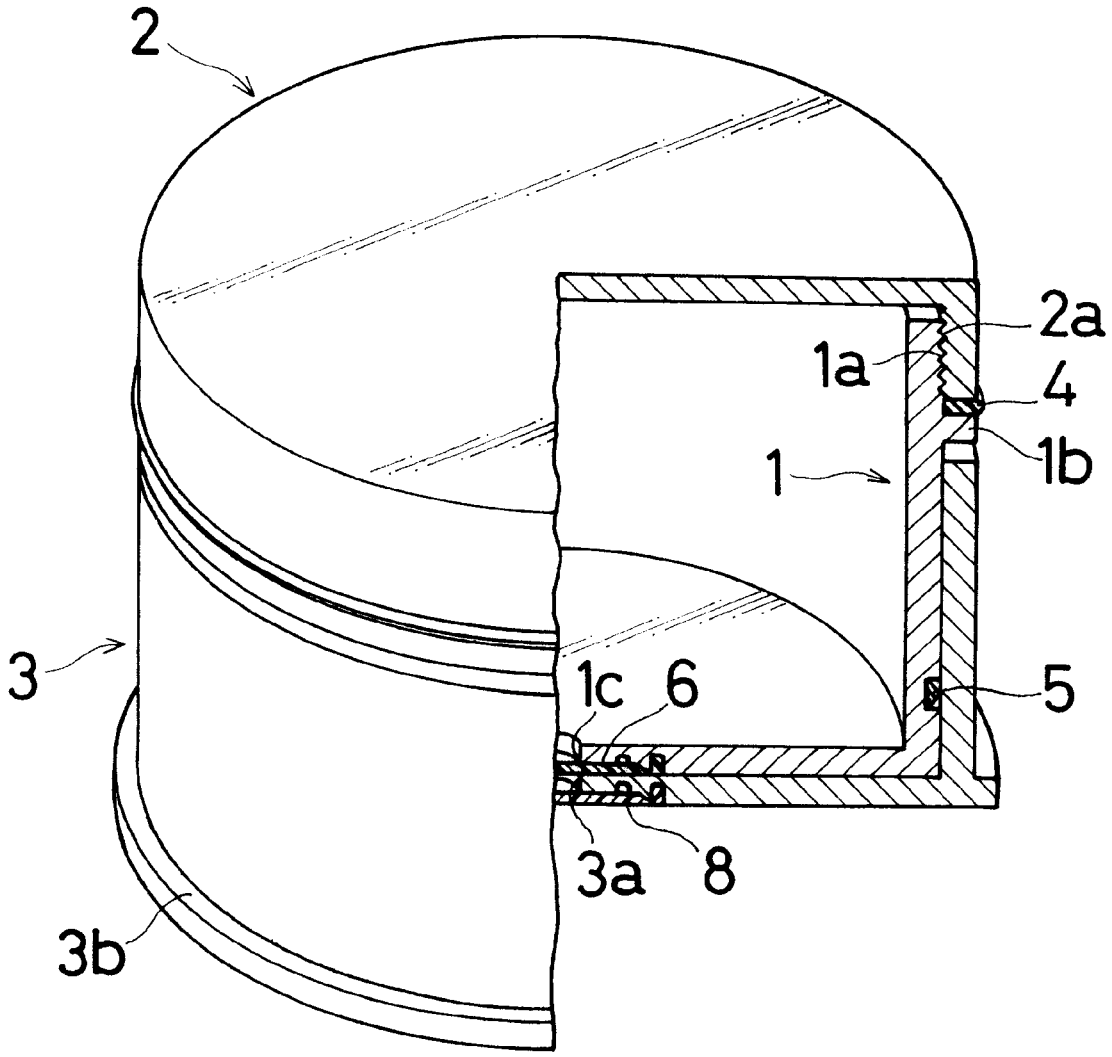
FIG. 1 shows an embodiment of the invention, and is a perspective view partly in vertical section of a vacuum airtight container.
Figure 4:
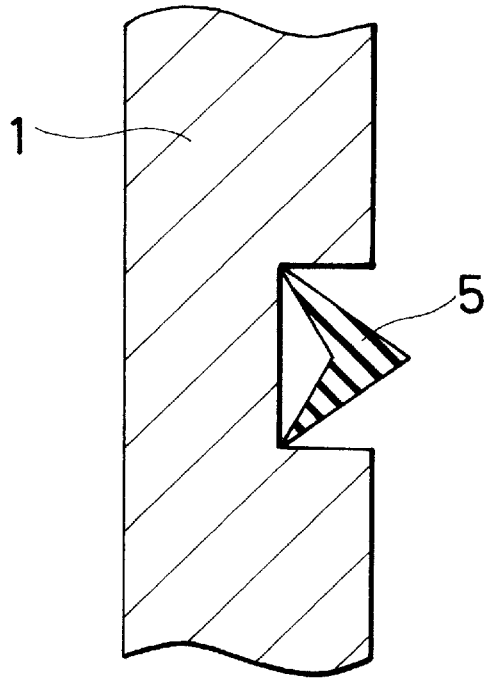
FIG. 4 shows the embodiment of the invention, and is a vertical section view of a V-shaped O-ring.
Figure 5:
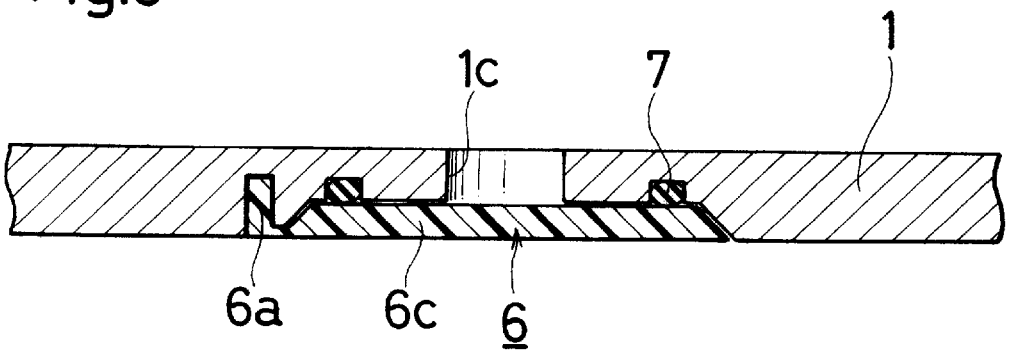
FIG. 5 shows the embodiment of the invention, and is a partially enlarged vertical section view showing a condition in which a check valve is closed.
Figure 6:
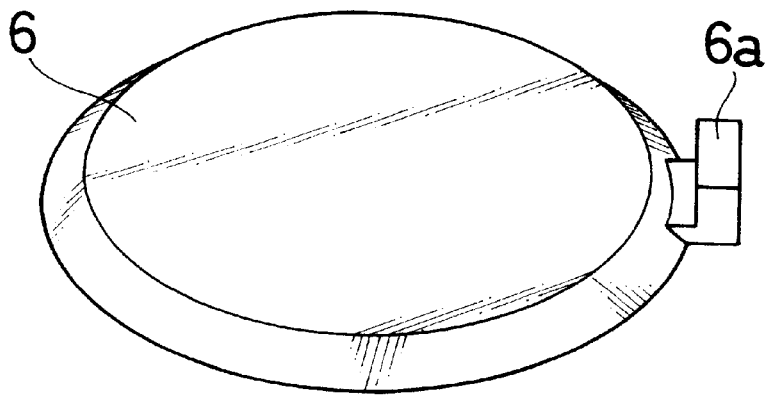
FIG. 6 is a perspective view of the check valve of the vacuum airtight container of the invention.
Figure 7:
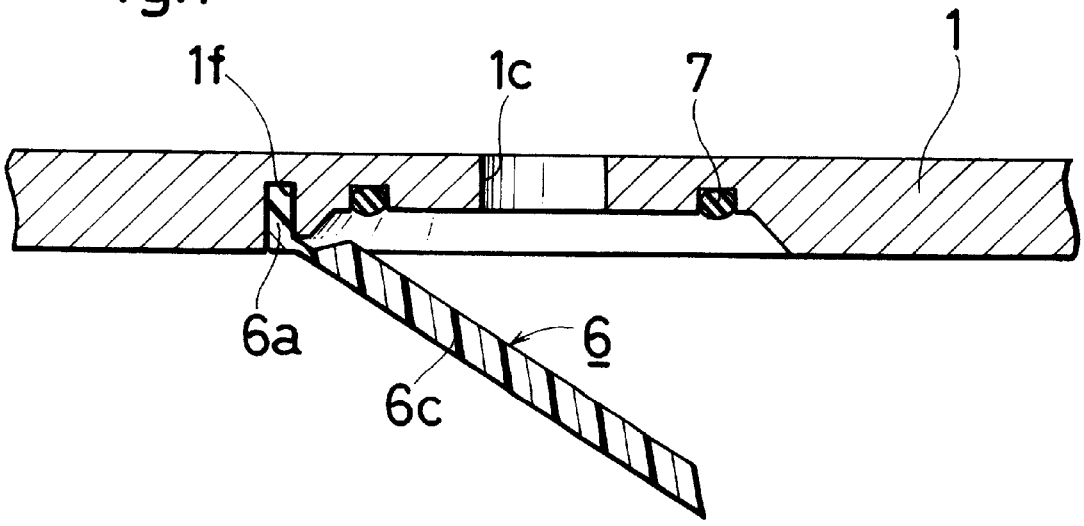
FIG. 7 shows the embodiment of the invention, and is a partially enlarged vertical section view showing a condition in which the check valve is opened.
Figure 8:
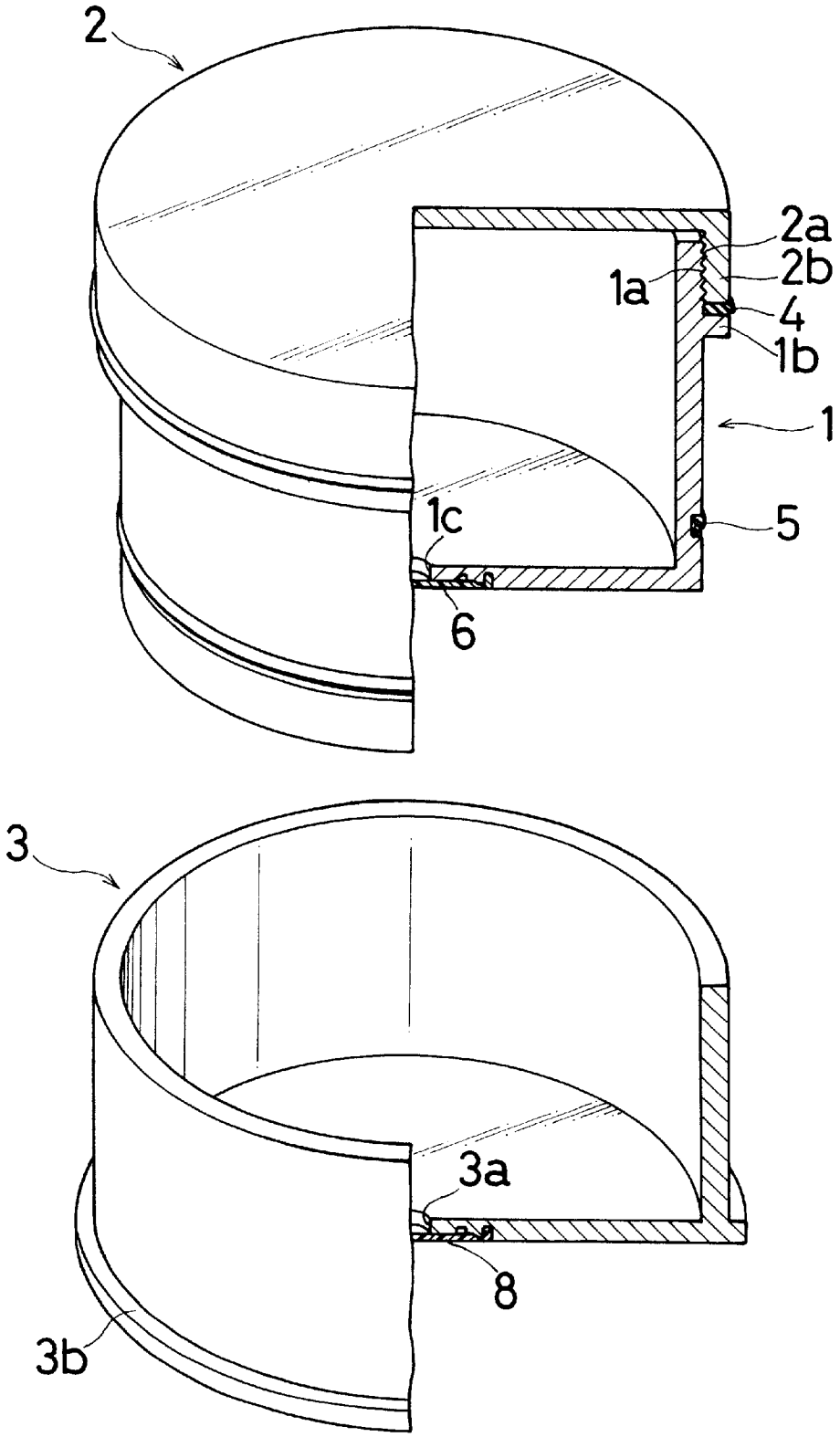
FIG. 8 shows the embodiment of the invention, and is a perspective view partly in vertical section of the inner container, the cover member, and an outer container.
Figure 9:
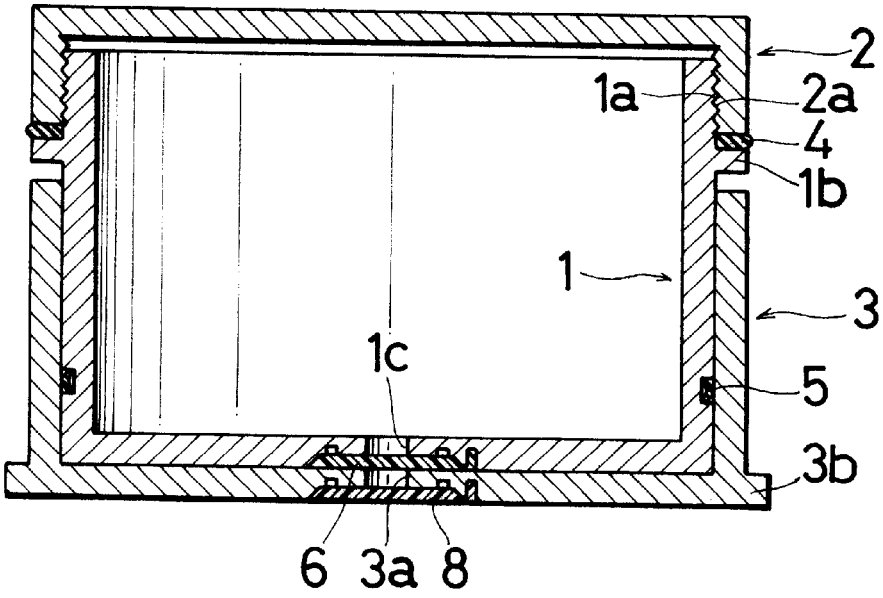
FIG. 9 shows the embodiment of the invention, and is a vertical section view of the vacuum airtight container.
Figure 10:
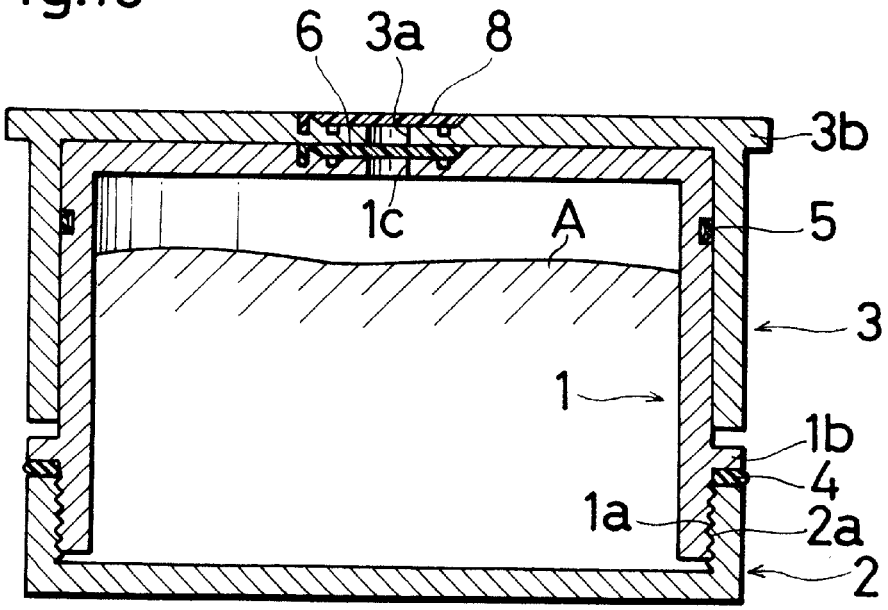
FIG. 10 shows the embodiment of the invention, and is a vertical section view of the vacuum airtight container which is turned upside down after accommodating food.
Figure 11:
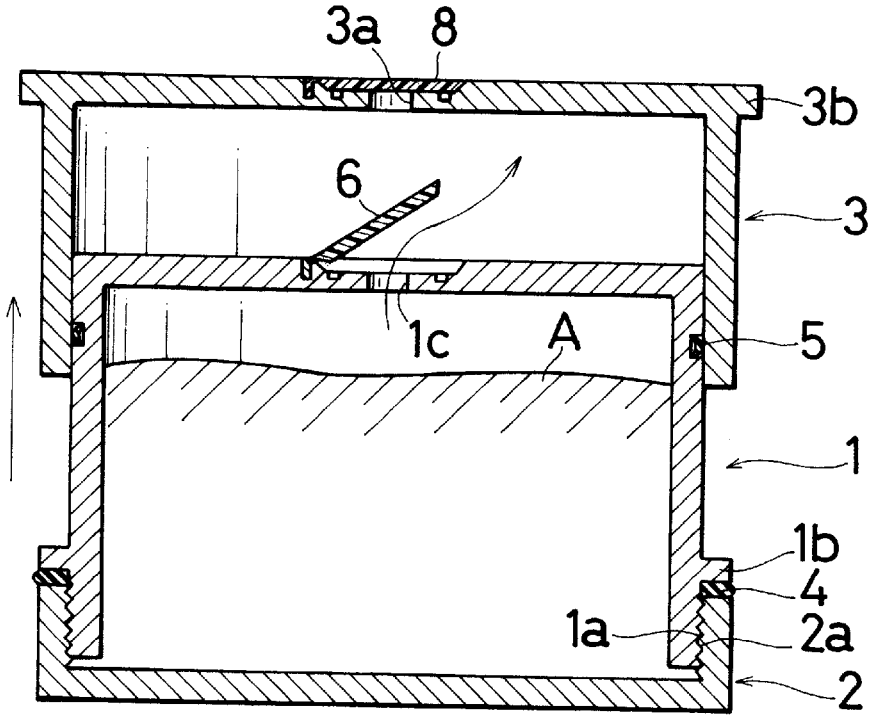
FIG. 11 shows the embodiment of the invention, and is vertical section view of the vacuum airtight container which is turned upside down in a condition where the outer container is pulled back.
Figure 12:
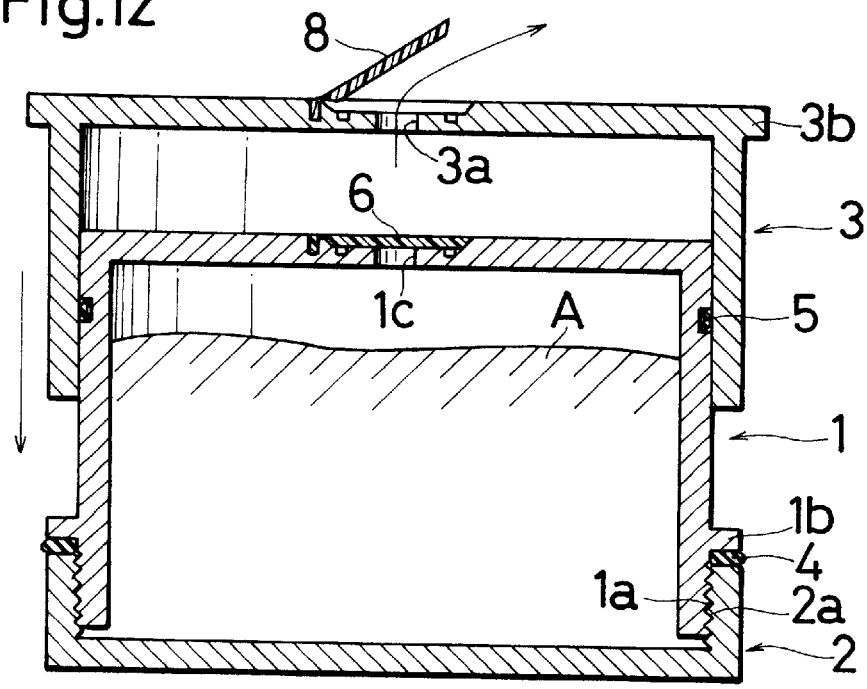
Figure 13:
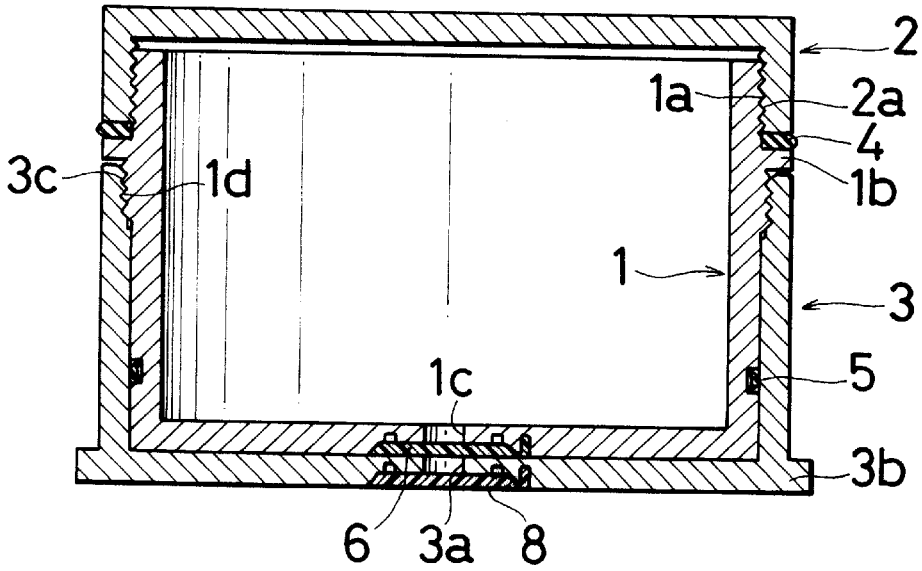
FIG. 13 shows the embodiment of the invention, and is a vertical section view of the vacuum airtight container and showing a configuration example in which the outer container is screw fastened to the inner container.
Figure 14:
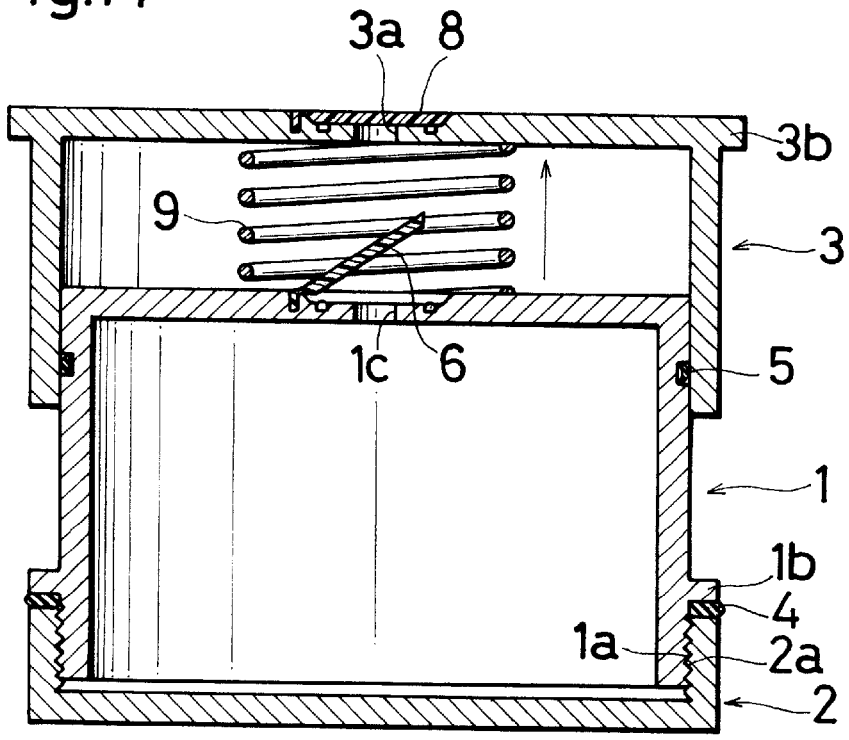
FIG. 14 shows the embodiment of the invention, and is a vertical section view of the vacuum airtight container and showing a configuration example in which a compression coil spring is disposed in the outer container.
Figure 15:
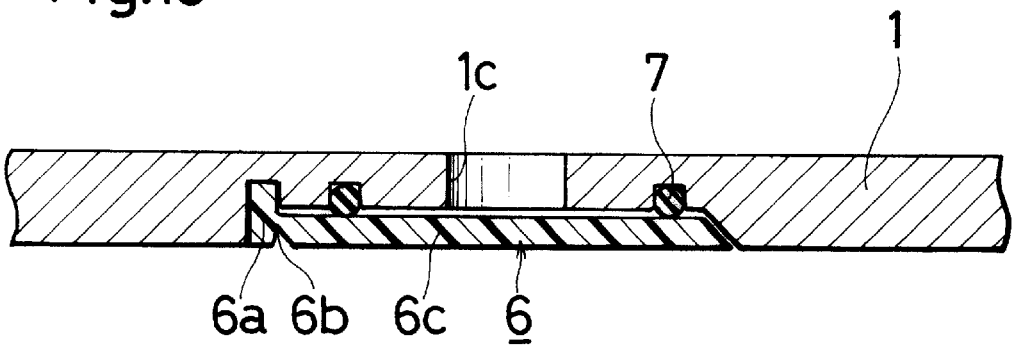
FIG. 15 shows the embodiment of the invention, and is a partially enlarged vertical section view showing a condition where a check valve having a recess is closed.
Figure 16:
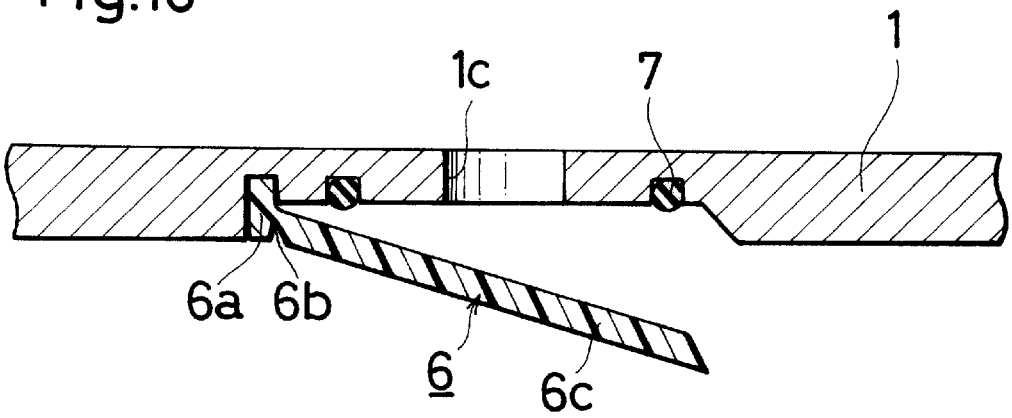
FIG. 16 shows the embodiment of the invention, and is a partially enlarged vertical section view showing a condition where the check valve having the recess is opened.
Figure 17:
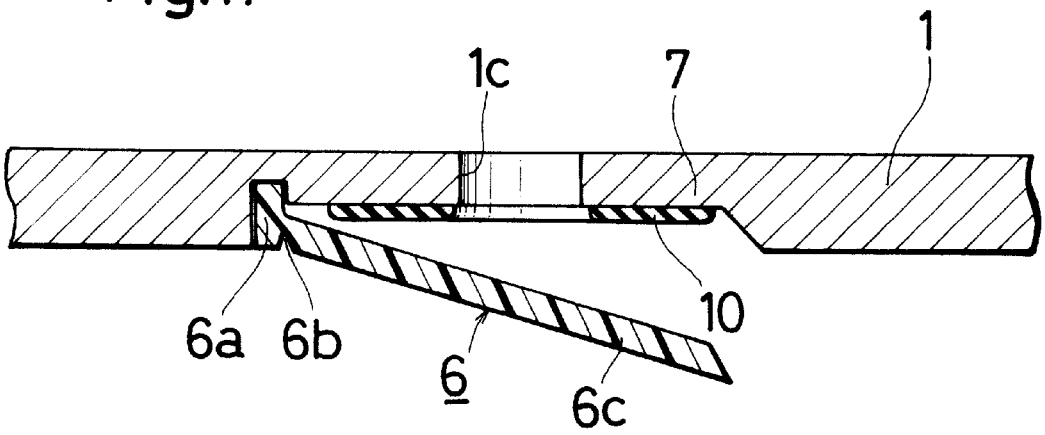
FIG. 17 shows the embodiment of the invention, and is a partially enlarged vertical section view in a case where the check valve is sealed by a washer-like sealing member.
Figure 18:
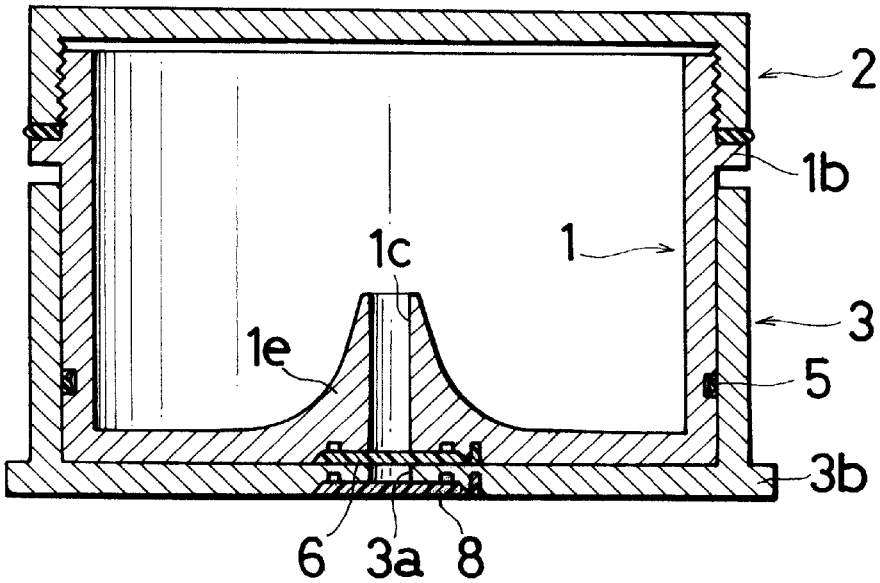
FIG. 18 shows the embodiment of the invention, and is a vertical section view of the vacuum airtight container and showing a configuration example in which a protruding portion is disposed in the inner container.
Figure 19:
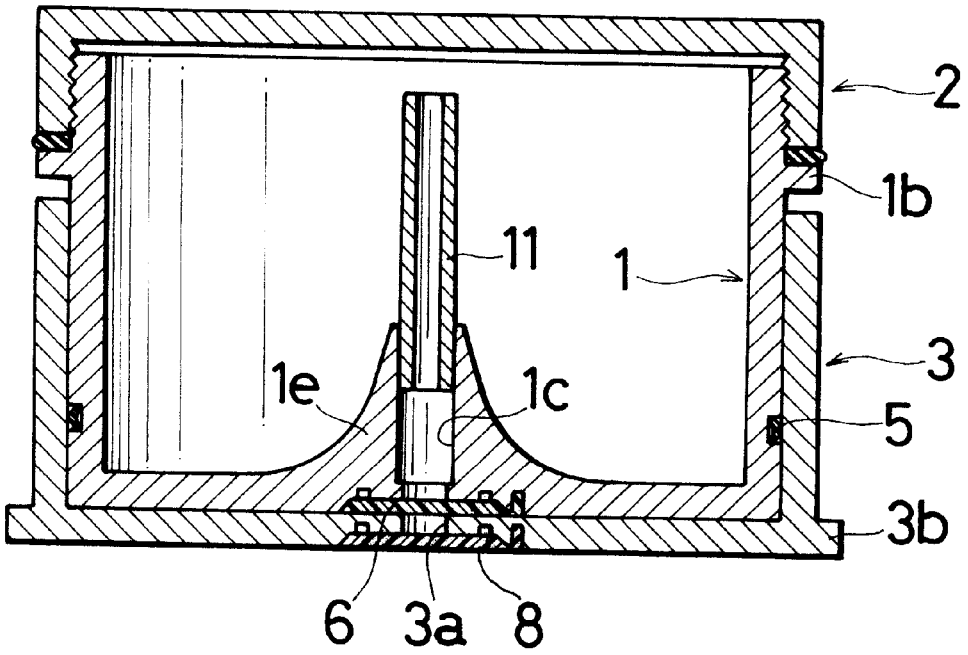
FIG. 19 shows the embodiment of the invention, and is a vertical section view of the vacuum airtight container and showing a configuration example in which a pipe is inserted into the protruding portion.

FIGS. 1 to 19 show an embodiment of the invention. FIG. 1 is a perspective view partly in vertical section of a vacuum airtight container, FIG. 2 is an assembly vertical section view showing the configuration of the vacuum airtight container, FIG. 3 is a perspective view partly in vertical section of an inner container and a cover member, FIG. 4 is a vertical section view of a V-shaped O-ring, FIG. 5 is a partially enlarged vertical section view showing a condition in which a check valve is closed, FIG. 6 is a perspective view of the check valve, FIG. 7 is a partially enlarged vertical section view showing a condition in which the check valve is opened, FIG. 8 is a perspective view partly in vertical section of the inner container, the cover member, and an outer container, FIG. 9 is a vertical section view of the vacuum airtight container, FIG. 10 is a vertical section view of the vacuum section airtight container which is turned upside down after accommodating food, FIG. 11 is a vertical section view of the vacuum airtight container which is turned upside down in a condition where the outer container is pulled back, FIG. 12 is a vertical section view of the vacuum airtight container which is turned upside down in a condition where the outer container is pressed in, FIG. 13 is a vertical section view of the vacuum airtight container and showing a configuration example in which the outer container is screw fastened to the inner container, FIG. 14 is a vertical section view of the vacuum airtight container and showing a configuration example in which a compression coil spring is disposed in the outer container, FIG. 15 is a partially enlarged vertical section view showing a condition where a check valve having an recess is closed, FIG. 16 is a partially enlarged vertical section view showing a condition where the check valve having the recess is opened, FIG. 17 is a partially enlarged vertical section view in a case where the check valve is sealed by a washer-like sealing member, FIG. 18 is a vertical section view of the vacuum airtight container and showing a configuration example in which a protruding portion is disposed in the inner container, and FIG. 19 is a vertical section view of the vacuum airtight container and showing a configuration example in which a pipe is inserted into the protruding portion.

Figure 2:
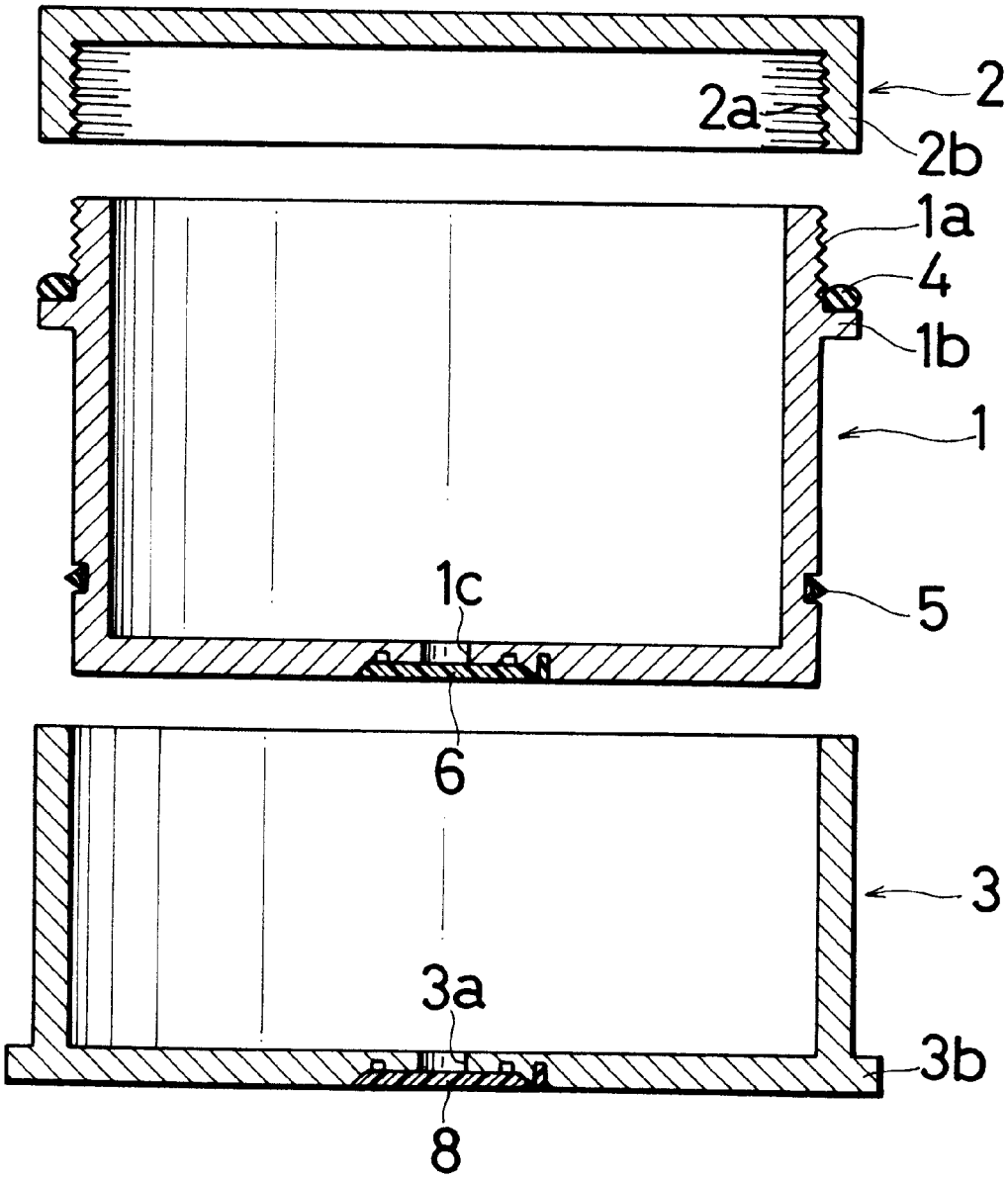
FIG. 2 shows the embodiment of the invention, and is an assembly vertical section view showing the configuration of the vacuum airtight container.
Figure 3:
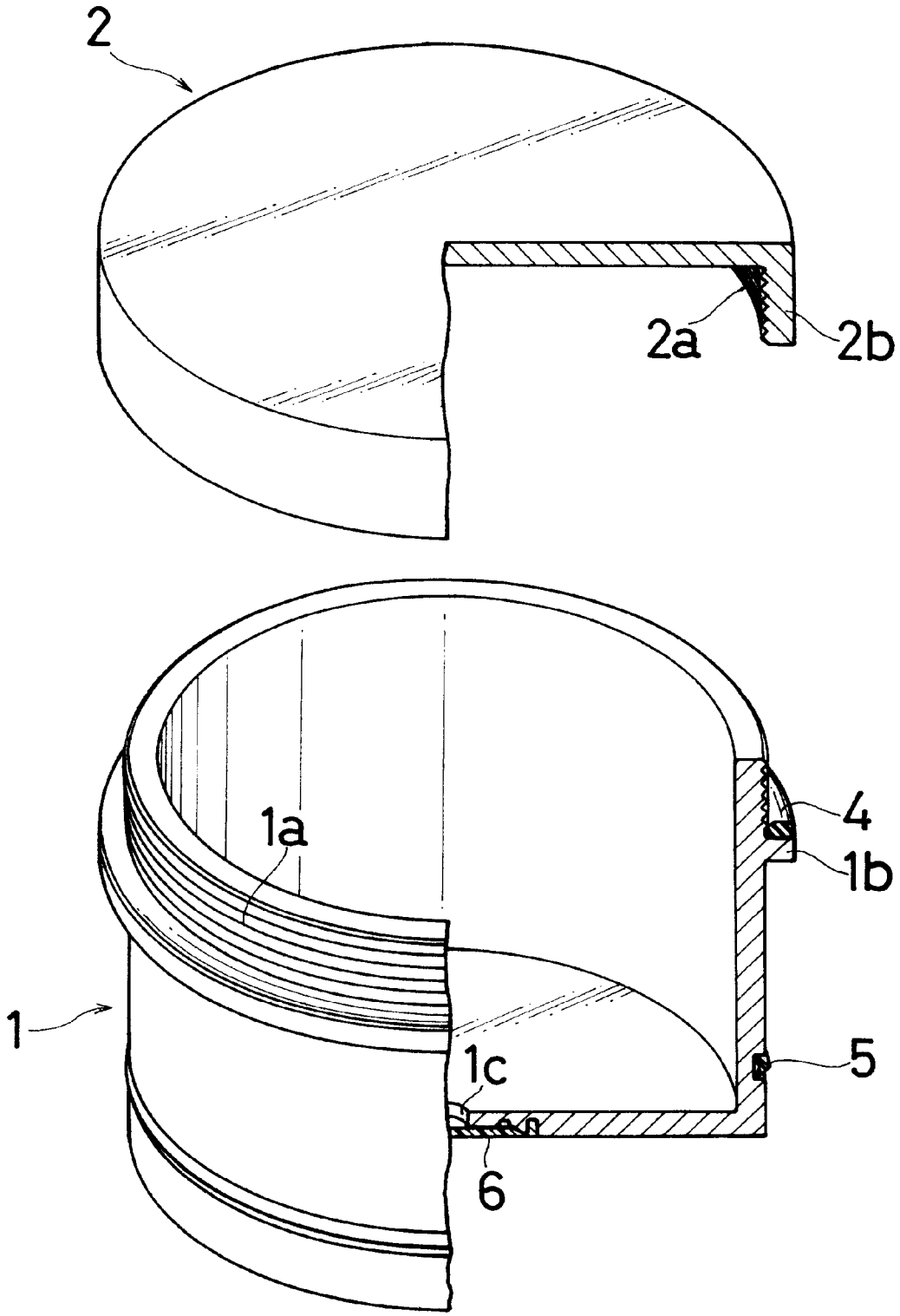
FIG. 3 shows the embodiment of the invention, and is a perspective view partly in vertical section of an inner container and a cover member.

The vacuum airtight container of the embodiment of the invention is configured, as shown in FIGS. 1 to 3, by an inner container 1 in which food or the like is to be accommodated, a cover member 2, and an outer container 3. All of the inner container 1, the outer container 3, and the cover member 2 are plastic-molded pieces. Alternatively, the pieces may be made of any material such as a metal or ceramics, as far as the material has some rigidity and hermeticity.

As shown in FIG. 3, the inner container 1 is a substantially cylindrical container having a bottom portion and an opened upper end portion. A male screw 1*a* is formed on an upper end portion of an outer circumferential face of a side wall of the inner container 1. An annular flange portion 1*b* protruding into an outer circumferential side is provided below the male screw 1*a* on the outer circumferential face of the side wall. An O-ring 4 as a sealing ring is externally fitted onto the male screw 1*a* on the outer circumferential face of the side wall, and stopped on the flange portion 1*b*. An annular groove is formed in a lower portion of the outer circumferential face of the side wall of the inner container 1. A V-shaped O-ring 5 as a sealing member is fitted into the groove. The V-shaped O-ring 5 has a V-shaped section, as shown in FIG. 4, and the protruding end of the V shape protrudes into the outer circumferential side. The section of the O-ring as the sealing member is not necessarily a V-shaped section.

A through hole 1*c* is formed in the center of the bottom portion of the inner container 1. A fringe of an opening portion on the lower face side of the through hole 1*c* is countersunk as shown in FIG. 5, and a check valve 6 is fitted thereinto. As shown in FIG. 6, the check valve 6 is configured by a valve element 6*c* which is made of rubber or the like having elasticity and is formed into a disc-like shape. One end portion of the valve element 6*c* protrudes so as to form a supporting portion 6*a*. The supporting portion 6*a* is fittingly fixed to a hole If formed in a fringe of the countersunk portion of the bottom portion of the inner container 1 by pressing or other means, so that the supporting portion 6*a* supports the check valve 6. An annular groove is formed in the countersunk portion of the bottom portion of the inner container 1 so as to surround the opening portion of the through hole 1*c*. An O-ring 7 is fitted into the groove. In the case where the air pressure of the outside of the inner container 1 is higher than that of the interior of the container, an upper face of the check valve 6 is in contact with the O-ring 7, so as to close the through hole 1*c*, as shown in FIG. 5. Only in the case where the air pressure of the outside of the inner container 1 is lower, the disc-like valve element 6*c* is downwardly bent, as shown in FIG. 7, so as to open the through hole 1*c*. The supporting portion 6*a* of the check valve 6 is fittingly fixed to the hole If in the bottom portion of the inner container 1. When the air pressures of the inside and the outside are equal to each other, therefore, the disc-like valve element is fitted again into the countersunk portion by the elasticity thereof, so as to close the through hole 1*c*. In other words, the check valve 6 is constituted by the supporting portion 6*a* and the valve element 6*c* which is elastically supported by the supporting portion 6*a*.

As shown in FIG. 3, the cover member 2 includes a side wall 2*b* which protrudes downwardly from a fringing portion of a disc-like portion. A female screw 2*a* is formed in an inner circumference of the side wall. The cover member 2 is attached to the inner container 1 by screwing (screw fastening) the female screw 2*a* into the male screw 1*a*, as shown in FIG. 8. At this time, the O-ring 4 as the sealing ring is pressed against the flange portion 1*b* of the inner container 1 by the lower end face of the side wall. Thus, the inner container 1 is hermetically sealed.

The outer container 3 is, similarly to the inner container 1, a substantially cylindrical container having a bottom portion and an opened upper end portion. A through hole 3*a* is formed in the center of the bottom portion. A check valve 8 which is configured in the same manner as the check valve 6 is fitted into a countersunk portion of a fringe of an opening portion on the lower face side of the through hole 3*a*.The outer container 3 is formed in such a manner that the diameter of an inner cylindrical portion thereof is slightly larger than that of an outer circumference of the side wall of the inner container 1. At a lower end of a side wall of the outer container 3, an annular flange portion 3*b* protruding into an outer circumferential side is disposed. A portion of the inner container 1 which is lower than the flange portion 1*b* of the inner container 1 is inserted into the inner cylindrical portion of the outer container 3, as shown in FIGS. 1 and 9. As a result of the insertion, the outer container 3 and the inner container 1 are upwardly and downwardly movable in a sliding manner, and the protruding end of the V-shaped O-ring 5 as the sealing member is pressingly in contact with the inner circumferential face of the side wall of the outer container 3. Thus, the hermetic condition can be attained between the outer container 3 and the inner container 1. For the sake of convenience in description, the check valve 6 is referred to as a second check valve, and the check valve 8 is referred to as a first check valve.

In the vacuum airtight container having the above-described configuration, for example, food A is accommodated inside the inner container 1 as shown in FIG. 10, the cover member 2 is screw fastened to the inner container, and the inner container 1 is then inserted into the outer container 3. Thereafter, the vacuum airtight container is turned upside down. In this condition, the inner container 1 and the outer container 3 are held by the right and left hands of a person, respectively, and only the outer container 3 is first pulled back. The air pressure of the interior of the outer container 3 is lowered, so that the second check valve 6 of the inner container 1 is opened as shown in FIG. 11. As a result, the air left in the interior of the inner container 1 is moved into the outer container 3. Next, the outer container 3 is pushed in. The air pressure of the interior of the outer container 3 is raised, so that the first check valve 8 of the outer container 3 is opened, as shown in FIG. 12. As a result, the air in the interior is externally discharged. The repetitive operations of pushing and pulling the outer container 3 function as a suction pump, and the air left in the interior of the inner container 1 can be sequentially discharged to the outside. When the air pressure of the interior of the inner container 1 is lowered as the result of the operations, the check valves 6 and 8 surely prevent the external air from entering the container. In the operation of pulling back the outer container 3, the flange portion 1*b* of the inner container 1 and the flange portion 3*b* of the outer container 3 function as resting portions for fingers of the right and left hands, so that the operation can be easily performed. The flange portion 3*b* of the outer container 3 is provided for this purpose.

When the food A is to be taken out of the vacuum airtight container, the cover member 2 is turned so as to loose the screw, and the cover member 2 is then removed from the inner container 1. As a countermeasure in the case where it is difficult to turn the cover member 2 because the inner air pressure of the inner container 1 is low, a releasing valve for releasing the inner air pressure to the atmospheric pressure may be provided.

According to the vacuum airtight container of the embodiment, the interior of the inner container 1 in which the food A is accommodated can be set to the vacuum (reduced pressure) condition, and the condition can be maintained. Therefore, the food A will not be exposed to the external air and the air left in the interior of the inner container 1 after the accommodation, so that the keeping quality can be enhanced. In the vacuum airtight container, the suction pump configured by the outer container 3 is formed integrally with the inner container 1 so as not to obstruct the preservation. It is also possible to eliminate the time and effort for looking for a suction pump, when another food A is to be accommodated.

As shown in FIG. 13, a male screw 1d may be additionally formed below the flange portion 1*b* on the outer circumferential face of the side wall of the inner container 1, and a female screw 3*c* may be formed on the inner circumferential face of the upper end portion of the side wall of the outer container 3. According to this configuration, by pushing and rotating the outer container 3, the outer container 3 can be fixed to the inner container 1 in a condition where the male screw 1*d* is screw fastened to the female screw 3*c*. Thus, the outer container 3 and the inner container 1 can be completely integrated with each other during the storage of the vacuum airtight container and the preservation of the food A.

The force required for the operation of pushing the outer container 3 is always substantially constant. If the pressure of the interior of the inner container 1 is lowered, a very strong force is required for the pulling back operation. For this reason, a compression coil spring 9 may be disposed inside the outer container 3, as shown in FIG. 14, or other urging means may be used. If the operation of pulling the outer container 3 is assisted by such means, the suction discharge operation can be effectively performed.

In the above-described embodiment, the supporting portion 6*a* of the second check valve 6 is formed so as to continuous to the disc-like valve element 6*c* only on the bottom face side (the check valve 8 has the same construction). Alternatively, as shown in FIG. 15, a recess 6*b* may be formed from the bottom face side between the disc-like valve element and the supporting portion 6*a*. As shown in FIG. 16, the portion of the recess 6*b* is bent, so that the disc-like valve element is opened. In the above-described embodiment, the disc-like valve element of the second check valve 6 (the check valve 8 has the same construction) is in contact with the O-ring 7, so that the through hole 1*c* is closed. Alternatively, as shown in FIG. 17, a sealing member 10 made of rubber or the like and having a washer-like (annular plate) shape may be stuck. As for the check valves 6 and 8, a check valve having any desired structure may be used. For example, an elastic body such as a spring urges a valve element having a ball-like shape or other shapes, so as to close the through hole 1*c*.

The inner container 1 may include a protruding portion 1*e*, as shown in FIG. 18. The protruding portion 1*e* is formed by upwardly protruding the fringe of the opening portion on the upper face side of the through hole 1*c* in the bottom portion. The protruding portion 1e is provided for, when the food A is juicy, preventing the juice from leaking to the outside via the through hole 1*c* during the accommodation. As shown in FIG. 19, if a pipe 11 may be inserted into the through hole 1*c* of the protruding portion 1*e* in an upwardly and downwardly movable manner. With this construction, even in the case where liquid food A is accommodated, it is possible to prevent the liquid from leaking to the outside via the through hole 1*c*. Alternatively, the protruding portion 1e may not be provided in the bottom plate of the inner container 1, and a pipe 11 may be pressingly fitted in the through hole 1*c*. In the case where the protruding portion 1*e* is not provided, a disc-like bottom plate which is not shown may be inserted in the inner container 1, and the food A may be accommodated by placing the food A on the bottom plate. The bottom plate has a number of minute holes for allowing the air to pass therethrough. Instead of the bottom plate, the fringe of the opening portion on the upper face side of the through hole 1*c* may be covered by a net.

In the above-described embodiment, one V-shaped O-ring 5 as a sealing member is disposed on the outer circumference of the side wall of the inner container 1. If two or more O-rings are disposed with intervals, the operations of pushing and pulling the outer container 3 can be more smoothly performed. As the sealing member, instead of the V-shaped O-ring 5, an O-ring having a usual circular section shape, or other sealing members can be used. If the sliding motion of the sealing member 5 with respect to the outer container 3 is not good, a lubricant such as grease may be used, so that the smooth sliding motion and the sealing property are ensured.

In addition, in the above-described embodiment, the male screw 1*a* is formed on the inner container 1 and the female screw 2*a* is formed on the cover member 2. Alternatively, a female screw may be formed on the inner container 1, and a male screw may be formed on the disc-like cover member 2. The O-ring 4 as a sealing ring may be pressed against the cover member 2 by the upper end face of the side wall of the inner container 1. Any other sealing member can be used for the O-ring 4. The cover member 2 may be fixed by an engaging member or the like via a sealing member such as an O-ring, instead of the screw fastening.

Figure 20:
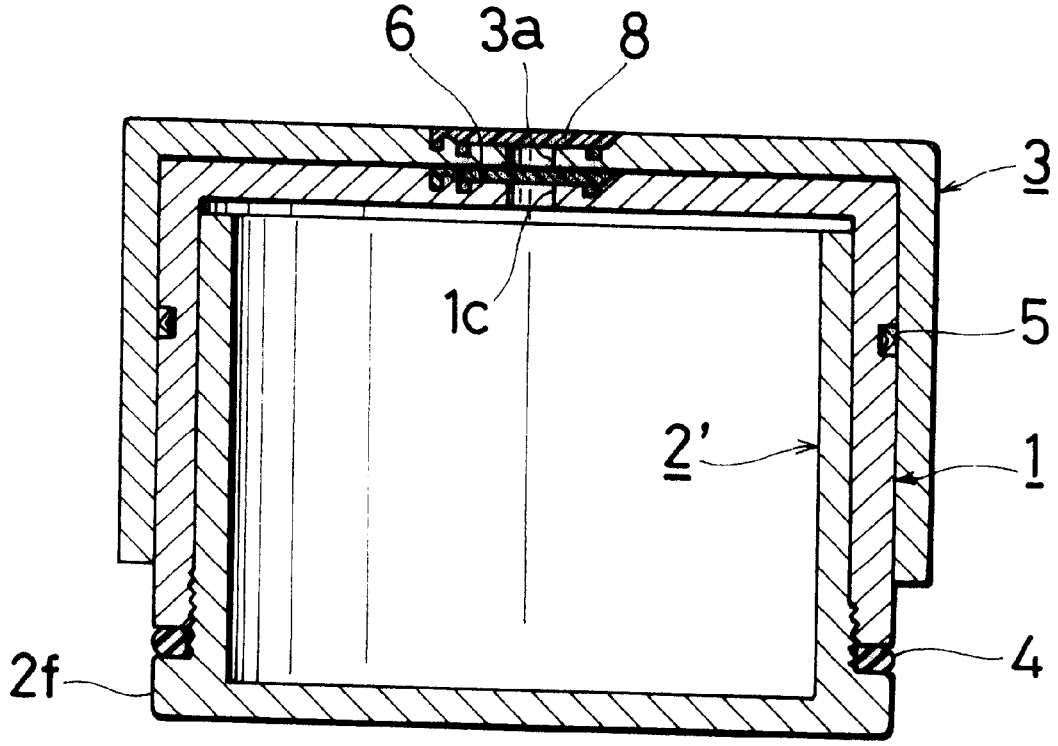
FIG. 20 shows another modified embodiment of the invention, and is a vertical section view of a vacuum airtight container.

In the configuration described above, as shown in FIG. 20, the cover member 2 may be replaced with a second inner container 2' in order to attain a deep container.

Figure 21:
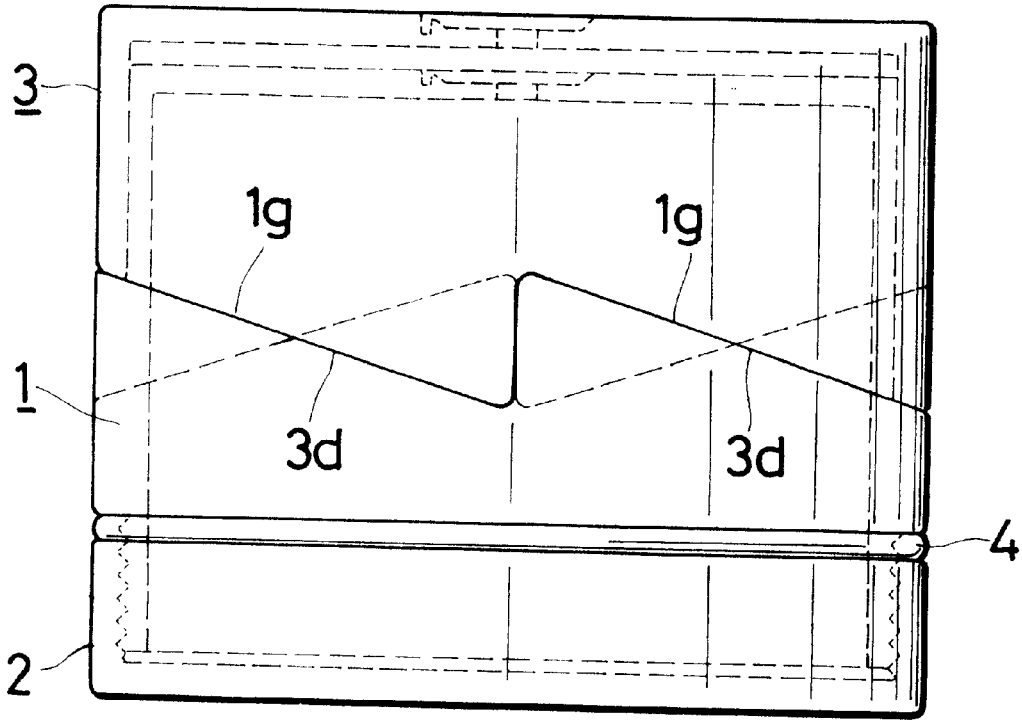
FIG. 21 shows a second embodiment of the invention, and is an external front view of a vacuum airtight container.
Figure 22:
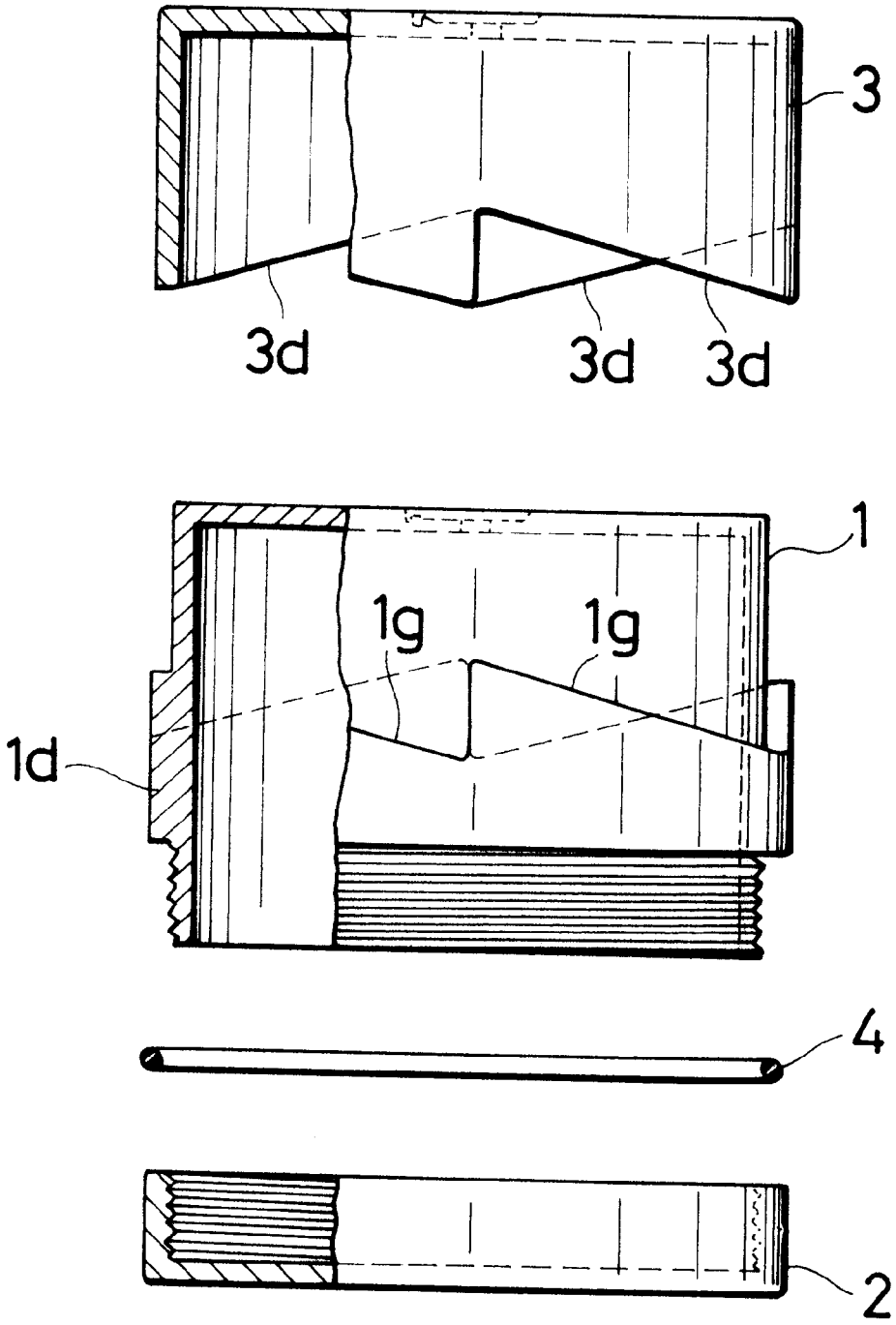
FIG. 22 shows the second embodiment of the invention, and is an exploded view showing the configuration of the vacuum airtight container, partly in vertical section.

FIG. 21 is an assembly view of an embodiment in which a vacuum generating operation of the vacuum airtight container of the invention is easily performed, and FIG. 22 is an exploded view showing the configuration.

When the internal space is to be vacuumed by relatively sliding the outer container 3 and a first inner container 1, a stronger force is required in the operation of relatively pulling back (pulling) between the outer container 3 and the first inner container 1 as the degree of vacuum of the internal space becomes higher. To comply with this, a vacuum airtight container shown in FIGS. 21 and 22 is provided in order to allow the pulling back operation to be easily performed even when the degree of vacuum is raised. As an example in which the pulling back operation can be easily performed even when the degree of vacuum is raised, the example of FIG. 14 wherein the compression coil spring 9 is disposed inside the outer container 3 has been described. Hereinafter, the case where the compression coil spring 9 is not used will be described.

The vacuum airtight container consists of the outer container 3, the first inner container 1, and the cover member 2. In place of the cover member 2, the second inner container 2' (see FIG. 20) may be used. A groove is formed in the outer circumference of the first inner container 1, and a sealing ring 5 is fitted into the groove. The O-ring 4 is interposed between the first inner container 1 and the cover member 2 so as to attain the sealing.

Spiral slopes 3*d* are formed at regular intervals in the circumferential direction on the end face of the opening portion of the outer container 3. In the first inner container 1, a center portion of the barrel portion is formed as a thick portion 1*d*, and spiral slopes 1*g* which conform to the spiral slopes 3*d* are formed at regular intervals in the circumferential direction on the end face of the thick portion 1*d*.

Figure 23:
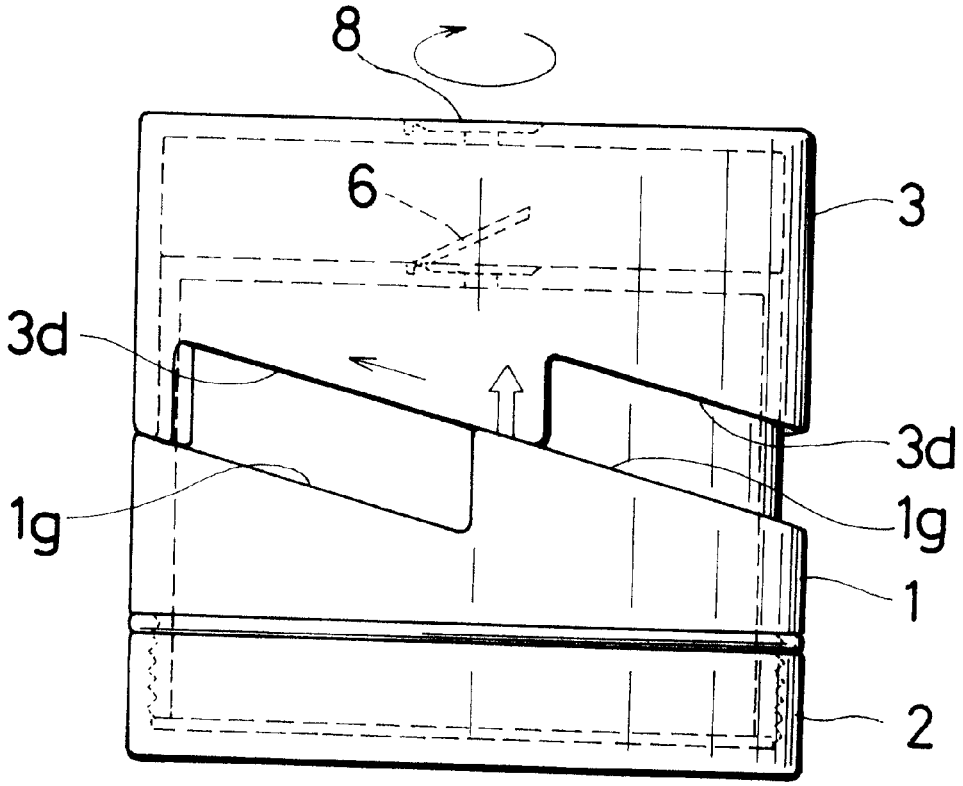
FIG. 23 shows the second embodiment of the invention, and is an external front view of the vacuum airtight container in a condition where the container is inverted and an outer container is pulled back.
Figure 24:
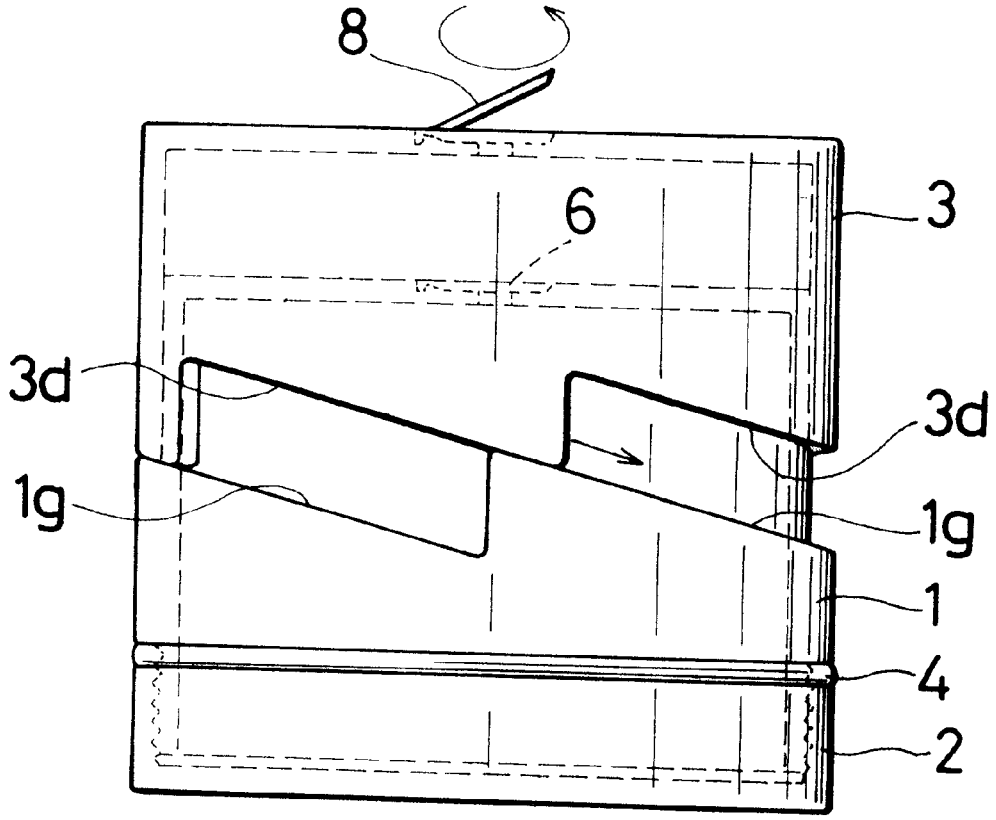

According to this configuration, the spiral slopes 3*d* and the spiral slopes 1*g* have mutual relationships similar to turning of a "screw" when the outer container 3 and the first inner container 1 are relatively rotated as shown FIGS. 23 and 24. Even when the degree of vacuum in the container is raised, therefore, the pulling back operation can be easily performed on the outer container 3 and the first inner container 1.

Figure 25A:
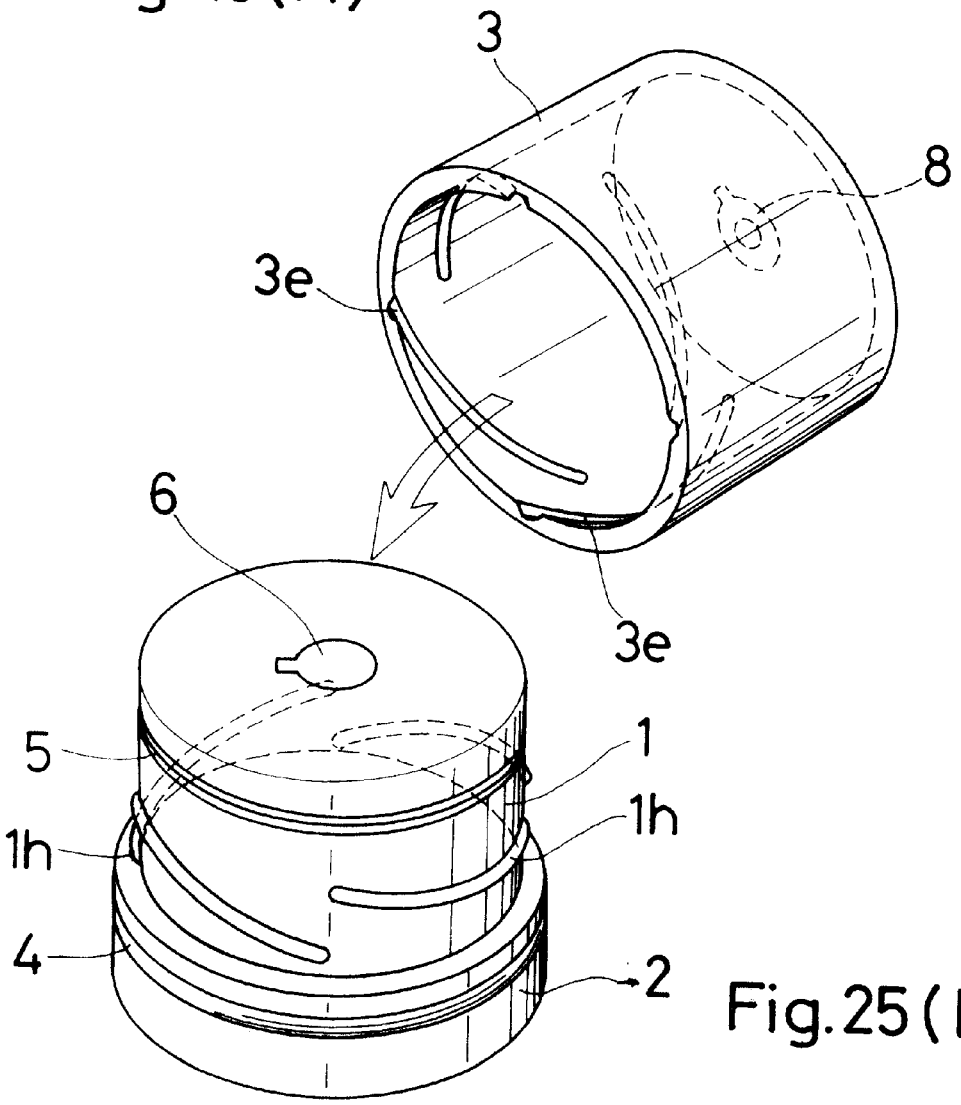
FIG. 25(A) is an exploded perspective view showing the configuration of a vacuum airtight container.
Figure 25B:
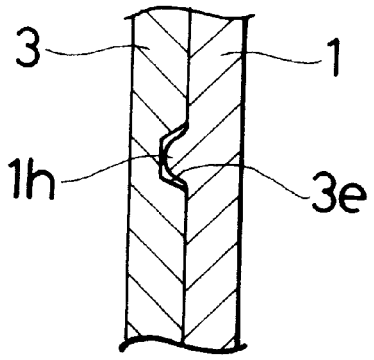
FIG. 25(B) is a partial section view showing a condition where an outer container is fitted onto a first inner container.

FIG. 25(A) shows a further embodiment in which the relative pulling (pulling) back operation can be easily performed on the outer container 3 and the first inner container 1, and FIG. 25(B) is a partial section view showing a condition where the outer container 3 is fitted onto the first inner container 1.

In the outer container 3, spiral grooves 3*e* are formed at regular intervals in the circumferential direction with starting from an end portion of the inner circumferential face of the opening portion. In the first inner container 1, spiral ridges 1h which can be respectively screwed with the spiral grooves 3*e* of the outer container 3 with forming a small gap are formed on the outer circumferential face. According to this configuration, the grooves 3*e* and the ridges 1h have mutual relationships similar to turning of a "screw" when the outer container 3 and the first inner container 1 are relatively rotated. Even when the degree of vacuum in the container is raised, therefore, the pulling back operation can be easily performed on the outer container 3 and the first inner container 1 because of the leverage function. Alternatively, spiral ridges may be formed on the inner circumferential face of the outer container 3, and spiral grooves may be formed in the first inner container 1.

In FIGS. 21 to 25, in order to facilitate the relative movement of the outer container 3 and the first inner container 1 in vertical direction, the spiral slopes 3*d* and the spiral slopes 1*g* which are to be fitted to the slopes 3*d*, or the spiral grooves 3*e* and the spiral ridges 1*h* which are to be fitted into the grooves are formed. Furthermore, screws which allow the inner circumferential face of the outer container 3 and the outer circumferential face of the first inner container 1 to be smoothly fitted to each other may be formed so that the pulling back operation is easily performed while reciprocally rotating the containers by a given angle. In the above-described embodiment, the inner container 1, the outer container 3, the cover member 2, and the like are cylindrical. If a screw fastening portion by means of screwing is not provided, the inner container 1, the outer container 3, the cover member 2, and the like may be polygonal, or ellipsoidal.

As apparent from the above description, according to the vacuum airtight container of the invention, the inner container is hermetically sealed by attaching the cover member to the inner container. The air left inside the inner container can be discharged to the outside by pushing and pulling the outer container. Thus, the keeping quality of food accommodated in the inner container can be enhanced, and the production cost can be reduced. Even when the degree of vacuum in the container is raised, furthermore, the pulling back operation can be easily performed.

What is claimed is:

1. A vacuum airtight container wherein a cylindrical inner container having a bottom portion provided with a second check valve which can discharge air to an outside only is slidably inserted into an inner cylindrical portion of a cylindrical outer container having a bottom portion provided with a first check valve which can discharge air to the outside only, in a hermetic condition, via a sealing member which is slidably contactable, and said inner container is hermetically sealed by attaching a cover member to a cylindrical upper end opening portion of said inner container via a sealing member.

2. A vacuum airtight container according to claim 1, wherein said check valve includes a valve element which can move in a direction along which a through hole formed in said bottom portion is closed, and urging means for urging said valve element in a direction along which said through hole is opened.

3. A vacuum airtight container according to claim 1 or 2, wherein sad sealing member which is slidably contactable is an O-ring having a V-shaped section, and said sealing member is fitted into a groove which is annularly formed in an outer circumference of a cylindrical side wall of said inner container, whereby a fringing portion protruding into an outer circumferential side is pressingly contacted with an inner circumferential face of a cylindrical side wall of said outer container.

4. A vacuum airtight container according to any one of claims 1 to 3, wherein said cover member is screw fastened to a cylindrical upper end portion of said inner container via a sealing ring, thereby hermetically sealing an upper end opening portion of said inner container.

5. A vacuum airtight container according to claim 4, wherein a male screw is formed on an outer circumference of an upper end portion of a cylindrical side wall of said inner container; an annular flange portion protruding to an outer circumferential side is disposed below said male screw on the outer circumference of the upper end of said side wall; a female screw is formed on an inner circumference of a side wall protruding downwardly from a fringing portion of said cover member; said female screw of said cover member is screw fastened to said male screw of said inner container; and a sealing ring disposed between a lower end of the side wall of said cover member and the flange portion of said inner container is pressed, thereby hermetically sealing the upper end opening portion of said inner container.

6. A vacuum airtight container according to any one of claims 1 to 5, wherein a spring is disposed between said inner container and said outer container.

7. A vacuum airtight container according to any one of claims 1 to 5, wherein an inner circumferential face of said outer container and an outer circumferential face of said inner container are screw coupled to each other and vertically movable in a relative manner.

8. A vacuum airtight container according to any one of claims 1 to 5, wherein spiral slopes are formed at regular intervals in a circumferential direction on an end face of an opening portion of said outer container, and, in said inner container, spiral slopes which conform to said spiral slopes are formed at regular intervals in a circumferential direction on an end face of a thick portion of a center portion of a barrel portion.

9. A vacuum airtight container according to any one of claims 1 to 5, wherein, in said outer container, spiral grooves or ridges are formed at regular intervals in a circumferential direction with starting from an end of an inner circumferential face of an opening portion, and, in said inner container, spiral ridges or spiral grooves which are to be screwed with said grooves or ridges of said outer container with forming a small gap are formed on an outer circumferential face.

10. A vacuum airtight container according to any one of claims 1 to 9, wherein said cover member is formed as a second inner container which is deep.

* * * * *